United States Patent [19]

Nishimura

[11] Patent Number: 4,640,345

[45] Date of Patent: Feb. 3, 1987

[54] ROTATING HEAT EXCHANGER

[76] Inventor: Jinichi Nishimura, 584-8 Ohaza Ushizu, Ushizu-machi, Ogi-gun, Saga, Japan

[21] Appl. No.: 656,225

[22] Filed: Oct. 1, 1984

[51] Int. Cl.[4] ..... F28F 5/02; F28D 11/02

[52] U.S. Cl. ..... 165/92; 165/86; 165/94

[58] Field of Search ..... 165/92, 93, 86, 94

[56] References Cited

U.S. PATENT DOCUMENTS

| | | | |
|---|---|---|---|
| 856,015 | 6/1907 | Appell | 165/92 |
| 1,262,432 | 4/1918 | Baird | 165/93 |
| 3,426,838 | 2/1969 | Onarheim | 165/94 |
| 3,650,319 | 3/1972 | Boon | 165/93 |
| 3,800,865 | 4/1974 | Onarheim et al. | 165/92 |
| 3,951,206 | 4/1976 | Williams | 165/92 |

FOREIGN PATENT DOCUMENTS

| | | | |
|---|---|---|---|
| 0626342 | 9/1978 | U.S.S.R. | 165/92 |

*Primary Examiner*—William R. Cline
*Assistant Examiner*—John K. Ford
*Attorney, Agent, or Firm*—Jordan and Hamburg

[57] ABSTRACT

This invention provides a structure of a heat exchanger in which a hollow drum, into which a heating or heated medium can be charged, is rotatably housed in a cylindrical outer casing, a large number of hollow projections are formed on the outer peripheral surface of the hollow drum, heating medium supply and discharge passages defined by a partition are provided within the hollow drum, and these heating medium supply and discharge passages communicate with hollow portions of the projections.

4 Claims, 13 Drawing Figures

ROTATING HEAT EXCHANGER

BACKGROUND OF THE INVENTION

This invention relates generally to a structure of a heat exchanger.

Conventional heat exchangers usually have a structure in which a freely-rotatable hollow drum is housed in an outer casing, a heating or heated medium is made to flow through the outer casing, and a heated or heating medium is also made to flow through the hollow drum, in order to effect heat exchange between the media.

In a conventional heat exchanger of this type, however, the heat exchange efficiency is low between the rotating hollow drum and the interior of the outer casing. Although fins or arms are provided on the hollow drum to increase its surface area, or a stirring mechanism is provided for stirring the interior of the outer casing, the heat exchange can not be done uniformly from inside the outer casing, and a marked drop in the heat exchange efficiency inevitably occurs because factors associated with the heat exchange efficiency other than the heat transfer area from the hollow drum are not taken into consideration.

Although the fins or arms are provided projecting from on the peripheral surface of the hollow drum in a conventional heat exchanger to improve the heat exchange efficiency between the interior of the outer casing and the hollow drum, an improvement in the heat exchange efficiency can not be accomplished simply by increasing the surface area by means of fins or arms, and by stirring, but heat-transfer areas of passage of the heating or heated medium must also be increased. Conventional heat exchangers do not pay sufficient attention to this point.

SUMMARY OF THE INVENTION

In a heat exchanger of the type in which a hollow drum containing a heating or heated medium is housed in an outer casing so as to provide a heat exchange between the heating or heated medium and a heated or heating medium such as a fluid that is made to flow through the interior of the outer casing, the present invention relates in particular to a structure of a heat exchanger in which hollow projections for the passage of the heating or heated medium are formed on the peripheral surface of the hollow drum, so that the heating or heated medium from the hollow drum can pass through the interior of the projections.

DESCRIPTION OF THE PREFERRED EMBODIMENTS

Figure 1:
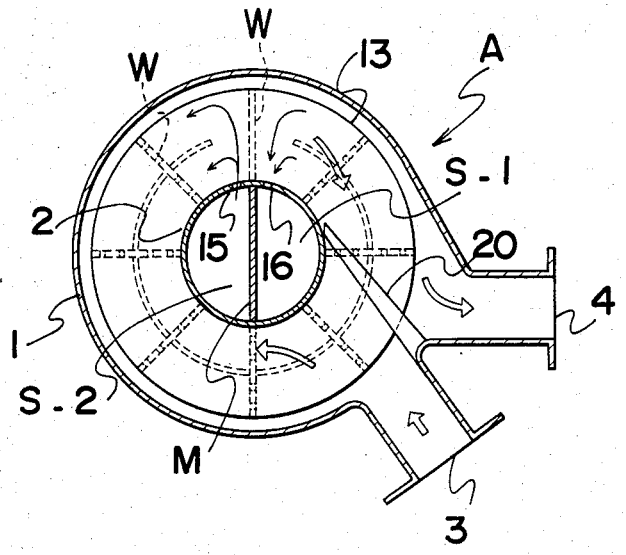
FIG. 1 is a sectioned front view of the structure of a heat exchanger in accordance with the present invention.

Some preferred embodiments of the present invention will now be described with reference to the accompanying drawings.

In the drawings, symbol A denotes a heat exchanger in accordance with the present invention. The heat exchanger A is constituted by fitting a hollow drum 2 into a cylindrical casing 1 so that the drum 2 is capable of rotating. An inlet port 3 is formed so as to open into the peripheral wall of the outer casing 1, while a discharge port 4 is formed so as to open in the direction of rotation of the hollow drum 2, inside the outer casing 1.

Figure 2:
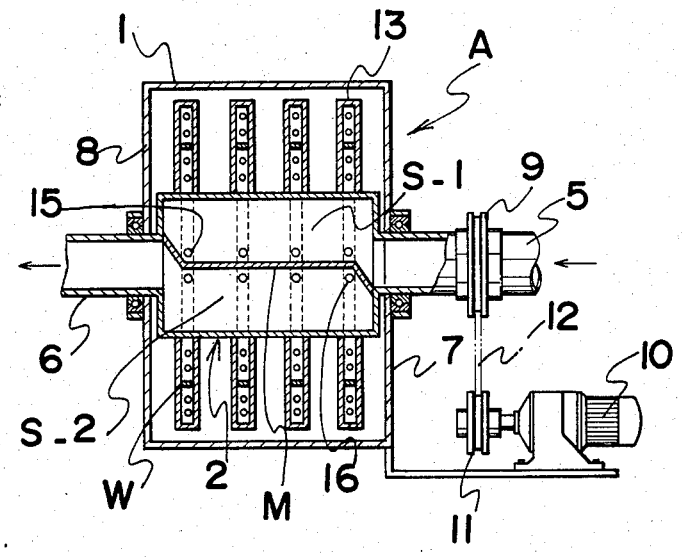
FIG. 2 is a sectioned side view thereof.
Figure 3:
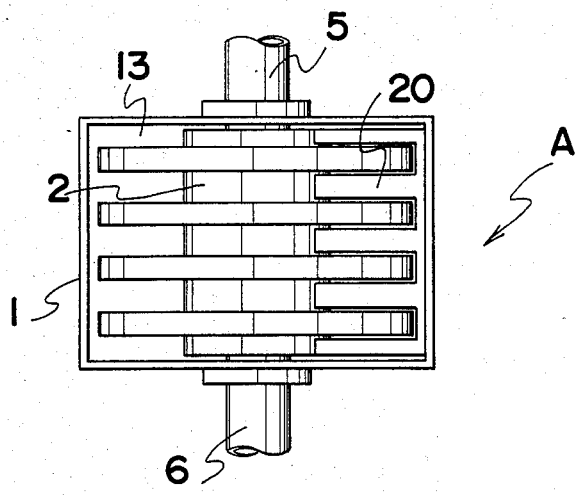
FIG. 3 is a plan view thereof.

The interior of the hollow drum 2 is hollow, and a heating medium supply pipe 5 and a heating medium discharge pipe 6, (FIG. 2) each communicating with the interior of the hollow drum 2, are formed in such a manner that they project to the right and left from the drum 2, respectively, so that the heating or heated medium can be supplied into, and discharged from, the interior of the drum 2. A separator M, that extends transversely, divides the interior of the drum 2 into a heating medium supply passage S-1 and a heating medium discharge passage S-2.

The heating medium supply pipe 5 communicates with one of the ends of the heating medium supply passage S-1, and the heating medium discharge pipe 6 communicates with one of the ends of the heating medium discharge passage S-2. The separator M is made of a thermal insulation material, or is subjected to a thermal insulation treatment. The two pipes 5 and 6 are supported by right and left side walls 7 and 8 of the outer casing 1, respectively, so that the drum 2 can rotate. A pulley 9 formed integrally with the supply pipe 5 is connected by a drive belt 12 to a driving pulley 11 of a motor 10, which is also mounted on the outer casing 1, so that the motor 10 can rotate the hollow drum 2.

Figure 6:
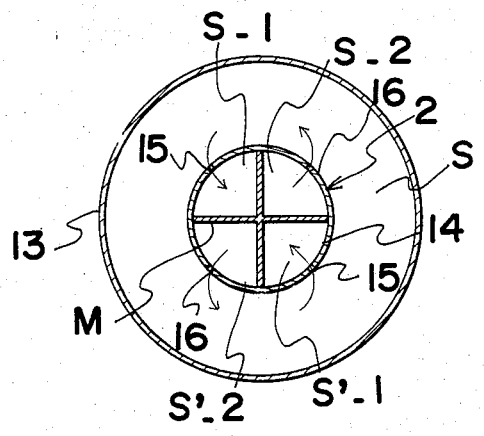
FIG. 6 is a section through a projection part in another embodiment of the invention.

The heating medium supply and discharge passages S-1 and S-2 defined by the separator M within the hollow drum 2 can have various constructions such as a separator M consisting of a single plate as shown in FIG. 1. For example, two of each of the heating medium supply and discharge passages S-1, S'-1 and S-2, S'-2 can be alternately formed by two plates crossing each other at right angles, as shown in FIG. 6. Alternatively, a tubular separator M, (FIGS. 7 and 8) which is concentric with the hollow drum 2 and which has one closed end, can be placed in the drum 2, so that the space between the hollow drum 2 and the tubular separator M is used as the heating medium supply passage S-1 while the interior of the tubular separator is used as the heating medium discharge passage S-2. As yet another alternative, two tubular separators M (FIG. 9) can be placed in the hollow drum 2 so that the interior of one of the tubular separators M is used as the heating medium supply passage S-1 while the interior of the other of the tubular separators M is used as the heating medium discharge passage S-2. In short, the separator M can have various shapes and constructions so long as it can divide the interior of the hollow drum 2 into an even number of spaces which can be used as alternate heating medium supply and discharge passages S-1 and S-2.

A large number of hollow projections 13 are formed so as to project from the peripheral surface of the hollow drum 2. They can have various shapes and constructions.

For example, a large number of disc-like projections can be juxtaposed with predetermined gaps between them, as shown in FIG. 1, arm-like projections can be provided, or fan-shaped projections can be arranged alternately.

An embodiment of the present invention in which the projections 13 have a disc-like shape will now be described. A hollow portion S (FIG. 4) of each disc-like projection 13 communicates with the heating medium supply and discharge passages S-1 and S-2 of the hollow drum 2, and has a communication structure which can be combined with the structures of the heating medium supply and discharge passages S-1 and S-2 that are shown in FIGS. 1, 6, 7 and 9. In FIG. 1, a supply port 15 and a discharge port 16 open into a peripheral wall 14 of the hollow drum 2, and communicate with the hollow portion S of the projection 13. The supply port 15 also communicates with the heating medium supply passage S-1, and the discharge port 16 with the heating medium discharge passage S-2, so that the heating or heated medium supplied into and flowing through the heating medium supply passage S-1 within the hollow drum 2 circulates from the supply port 15 through the interior of the disc-like projections 13, then reaches the heating medium discharge passage S-2 through the discharge port 16 and is thereafter discharged out of the hollow drum 2, and the heating or heated medium always circulates inside the hollow projections 13 to improve the heat exchange efficiency.

In FIG. 6, two each of the supply ports 15 and discharge ports 16 are provided at positions spaced from one another at about 90° around the peripheral wall 14 of the hollow drum 2, so that each communicates with the hollow portions S of the projections 13. The supply ports 15 communicate with the heating medium supply passages S-1 and S'-1, and the discharge ports 16 with the heating medium discharge passages S-2 and S'-2.

Figure 7:
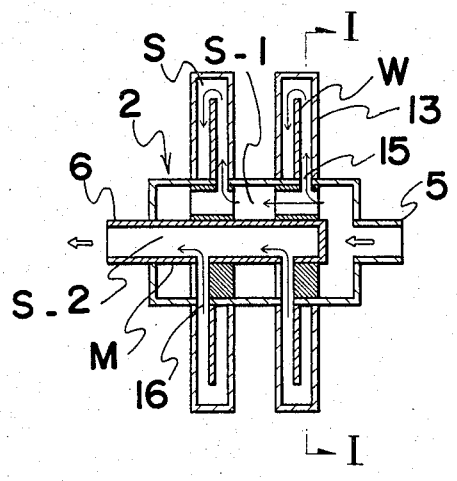
FIG. 7 is a sectioned side view of of a modification of the embodiment of FIG. 6.
Figure 8:
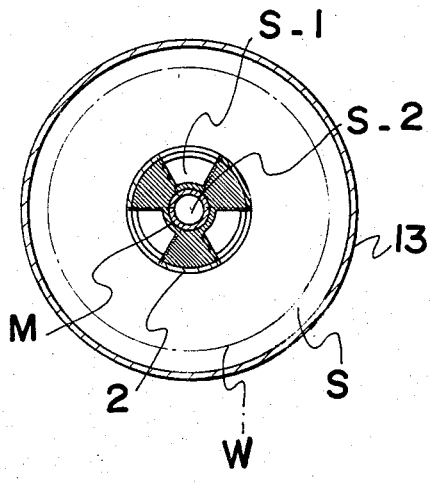
FIG. 8 is a section taken along the line I—I of FIG. 7.

In FIG. 7, the supply and discharge ports 15 and 16 communicating with the hollow portions S of the projections 13 are formed at symmetrical positions in the peripheral wall 14 of the hollow drum 2, and the supply ports 15 communicate with the heating medium supply passage S-1 between the tubular separator M and the inner peripheral wall of the hollow drum 2, while the discharge ports 16 communicate with the heating medium discharge passage S-2 inside the tubular separator M.

Figure 9:
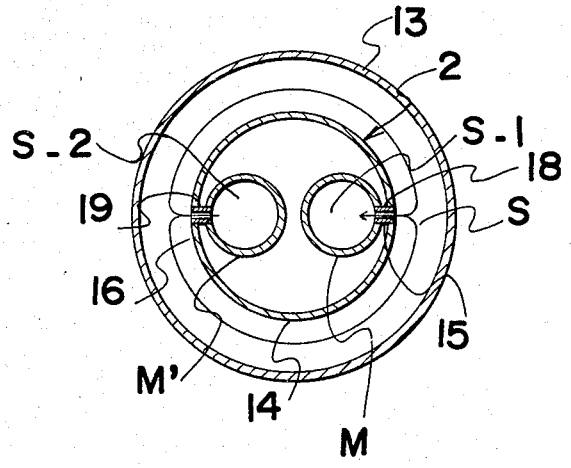
FIG. 9 is a section through a projection part of another embodiment of the invention.
Figure 10:
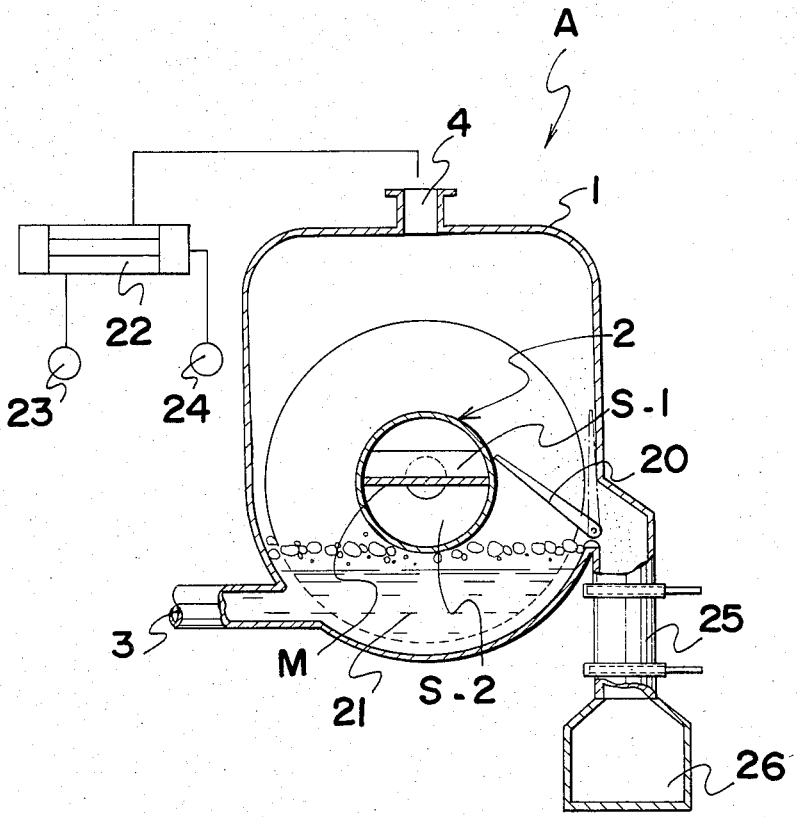
FIG. 10 is a sectioned front view of another embodiment of the invention.
Figure 11:
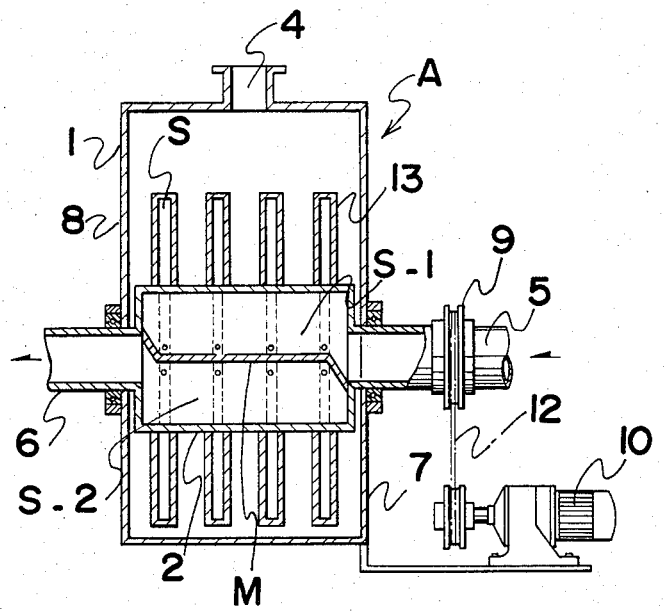
FIG. 11 is a sectioned side view of FIG. 10.

In FIG. 9, the supply and discharge ports 15 and 16 communicating with the hollow portions S of the projections 13 are formed projecting at symmetrical positions from the peripheral wall 14 of the hollow drum 2, and communicate with the interior of tubular separators M and M' through communication passages 18 and 19, respectively, which are continuously formed along the two tubular separators M and M'.

As described above, the heating medium supply and discharge passages S-1 and S-2 of the hollow drum 2 communicate with the hollow portions S of the disc-like projections 13, so that the heating or heated medium can circulate and flow within the projections 13.

Figure 4:
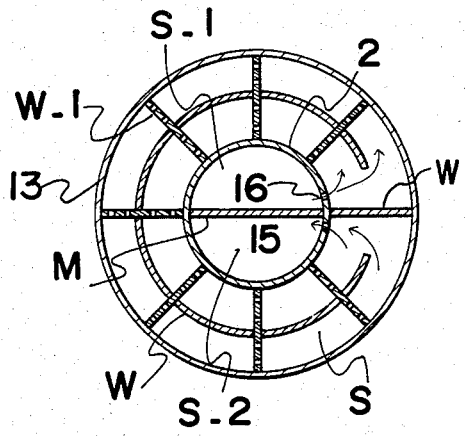
FIG. 4 is a section through a projection part.
Figure 5:
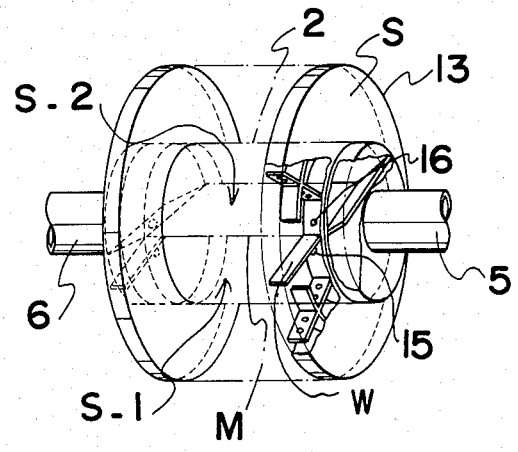
FIG. 5 is a perspective view of the projection part.
Figure 12:
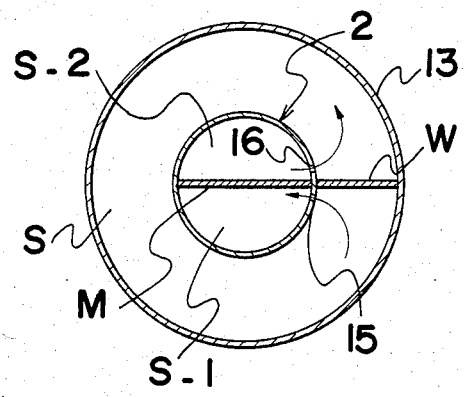
FIG. 12 is a section of the projection part thereof.
Figure 13:
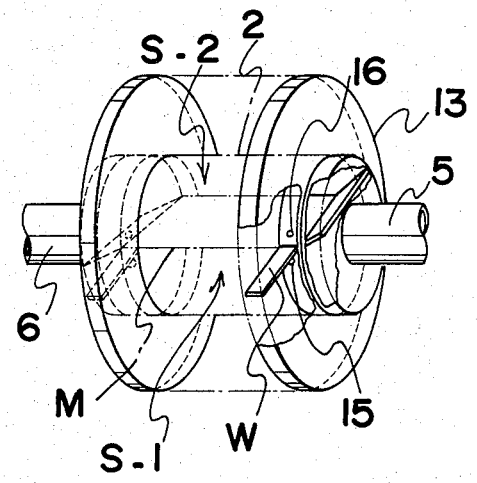
FIG. 13 is a perspective view of the projection part.

Various partition walls W can be provided within the hollow portions S of the projections 13, in order to promote the circulation and flow of the heating or heated medium, and improve the heat exchange efficiency with the heated or heating medium inside the outer casing. In FIGS. 4, 7, and 12 a partition W is shown provided between the supply port 15 and the discharge port 16 in such a manner that the hollow portion S of each projection 13 is divided into two. In FIG. 4, a large number of each of annular and radial partitions are shown arranged within each projection, to define a large number of separated spaces. In this case, communication ports W-1 providing communication between the separated spaces are bored through each partition other than the partition W. In FIG. 7, a radial partition W is shown arranged within each projection 13 between the supply port 15 and the discharge port 16, so as to divide the interior of each projection 13 into front and rear spaces substantially following the shape of the projection, these spaces communicating with each other at the outer edges thereof. The shapes and constructions of these partitions W are not specifically limited to those illustrated above, they can have any shape such that the heating or heated medium can flow smoothly throughout the interior of each projection.

In the drawings, reference numeral 20 denotes a scraper plate provided at the discharge port 4 of the outer casing 1. It scrapes off any substances from the heating or heated medium which are deposited onto the surfaces of the projections 13 and hollow drum 2. The scraper plate is provided with a cutout conforming to the shape of each projection 13 so that the deposited substances can be scraped of the entire surfaces of the projections 13 and hollow drum 2 as the hollow drum 2 rotates.

FIGS. 10 through 13 show another embodiment of the present invention in which the structure of the heat exchanger of the invention is utilized for a separator which separates solid components from a liquid. Reference numeral 21 denotes the liquid containing the solid components that flows in through the inlet port 3. The liquid is heated by the heating medium which passes through the hollow drum 2 and the projections 13, so that moisture is vaporized and is taken out from the discharge port 4 through a condenser 22. Reference numeral 23 denotes a vacuum pump, and reference numeral 24 a pump for cooling water.

When the moisture is vaporized from the liquid containing the solid components, the solid components are deposited onto the surfaces of the disc-like projections 13, and are scraped off by the scraper plate 20. They are then guided to a solid component tank 26 through a solid component discharge pipe 25 that communicates with the outer casing 1.

In the structures of the embodiments of the invention described above, the heating or heated medium flows into the outer casing 1 through the inlet port 3, and leaves the casing through the discharge port 4. Another medium enters the heating medium supply passages S-1 inside the hollow drum 2 from the heating medium supply pipe 5. When the hollow drum 2 is rotated, the heating or heated medium flowing into the heating medium supply passage S-1 of the hollow drum 2 flows into the hollow portions S of the projections 13 from the supply port 15, circulates within the hollow portions S, reaches the heating medium discharge passage S-2 from the discharge port 16, and is thereafter discharged out of the apparatus from the heating medium discharge pipe 6. Accordingly, the heating or heated medium can smoothly circulate within the hollow drum 2 as well as inside the projections 13, and can provide a heat exchange with heated or heating medium within the outer casing 1.

In addition, the partitions W provided inside the hollow portions S of the projections 13 enables the heating or heated medium to uniformly circulate within the projections.

In accordance with the present invention, the heating or heated medium can smoothly circulate within the hollow drum 2 and the hollow portions S of the projections 13, so that the heating or heated medium does not stay within the hollow drum 2 and the projections 13, and can effect an efficient heat exchange over the entire surface of the projections 13. Thus, the heat exchange efficiency can be greatly improved.

What is claimed is:

1. A heat exchanger comprising:

(a) a hollow drum through which a heating or heated medium can be circulated, (b) means rotably mounting said hollow drum within an outer casing, inlet means for introducing fluid into said outer casing, (c) an outlet means for discharging said fluid after being heated from said outer casing, (d) a plurality of hollow and disc-like projections mounted on the outer peripheral surface of said hollow drum, (e) first partition means dividing the interior of said hollow drum into supply and discharge passages, (f) a supply port for each projection at said peripheral wall of said hollow drum communicating with said supply passage and a discharge port for each projection at said peripheral wall of said hollow drum communicating with said discharge passage, whereby said heating medium supply and discharge passages each communicate with the interior of hollow portions of said projections, (g) second partition means within each of said hollow disc-like projections between a supply port and a discharge port thereof for directing fluid around the interior of said projection from said supply port to said discharge port, said second partition means comprising a solid radial wall disposed between said supply port and said discharge port, said solid radial wall defining a C-shaped fluid passage in said disc-like partition and (h) a plurality of perforated radial walls disposed in said C-shaped fluid passage in a circumferentially spaced-apart manner, said each perforated radial wall having a multiplicity of small communicating apertures through which said fluid passes and circumferential wall disposed within said C-shaped fluid passage dividing said flow passage into inner and outer flow passages.

2. A heat exchanger according to claim 1, wherein said outlet means mounted on said outer casing is utilized for discharging vapor and said outer casing is further provided with a solid component discharge pipe through which solid component in said fluid is discharged to a solid component tank.

3. A heat exchanger as defined in claim 1, wherein said first partition means which divides the interior of said hollow drum comprises a plate.

4. A heat exchanger as defined in claim 1, wherein said first partition means which divides the interior of said hollow drum comprises at least two plates at an angle to each other to divide the hollow drum into a plurality of inlets and a plurality of outlets.

* * * * *